US005083059A

United States Patent [19]

Graham et al.

[11] Patent Number: 5,083,059

[45] Date of Patent: Jan. 21, 1992

[54] ELECTRODE FOR METAL HALIDE DISCHARGE LAMP

[75] Inventors: Timothy W. Graham, Union Springs; John Scoins, Skaneateles, both of N.Y.

[73] Assignee: Welch Allyn, Inc., Skaneateles Falls, N.Y.

[21] Appl. No.: 636,743

[22] Filed: Dec. 31, 1990

[51] Int. Cl.[5] ..... H01J 17/04

[52] U.S. Cl. ..... 313/631; 313/632; 313/574; 313/335

[58] Field of Search ..... 313/631, 632, 574, 335

[56] References Cited

U.S. PATENT DOCUMENTS

| | | | |
|---|---|---|---|
| 2,272,467 | 2/1942 | Kern et al. | 313/283 X |
| 2,459,579 | 1/1949 | Noel | 313/631 X |
| 2,545,884 | 3/1951 | Isaacs et al. | 313/620 |
| 2,716,713 | 8/1955 | Noel | 313/632 X |
| 3,248,586 | 4/1966 | Schlegel | 313/632 X |
| 3,324,332 | 6/1967 | Waymouth et al. | 313/285 X |
| 3,379,868 | 4/1968 | Taillon | 362/263 |
| 3,502,929 | 3/1970 | Ritcher | 313/570 X |
| 3,581,133 | 5/1971 | Ushio | 313/632 X |
| 4,161,672 | 7/1979 | Cap et al. | 313/620 |
| 4,804,888 | 2/1989 | Nasu et al. | 313/631 X |
| 4,808,876 | 2/1989 | French et al. | 313/573 X |
| 4,968,916 | 11/1990 | Davenport et al. | 313/631 X |

*Primary Examiner*—Donald J. Yusko
*Assistant Examiner*—Ashok Patel
*Attorney, Agent, or Firm*—Wall and Roehrig

[57] ABSTRACT

A low-wattage metal-halide discharge lamp has a tube of the double ended type that forms a bulb or envelope, a pair of electrodes, e.g., an anode and a cathode, which penetrate into an arc chamber inside the envelope, and a suitable amount of mercury plus one or more metal halide salts. The electrodes are each formed of a refractory metal, i.e., tungsten wire, extending through the respective necks into the arc chamber. The electrodes are of a composite design i.e., in the form of a club, with a lead-in wire of small diameter supported in the associated neck, and a post member of greater diameter supported on the lead-end wire. The post members are supported of contact with the necks and also out of contact with the bulb wall. The larger size of the post member allows heat at the tip to diffuse back into the post member, so that the metal tip will not evaporate. The narrow lead-in wire keeps most of the heat in the bulb, so that flow of heat out of the neck portions is limited. Lamps of this design achieve high efficacy at relative low power (below 30 watts).

11 Claims, 2 Drawing Sheets

ELECTRODE FOR METAL HALIDE DISCHARGE LAMP

BACKGROUND OF THE INVENTION

The present invention relates to metal halide vapor discharge lamps, and more particularly to lamps that have efficacies in excess of 35 lumens per watt, in some cases over 100 lumens per watt, at low to medium power, i.e. under 30 watts, and in some cases up to 40 watts. The present invention is more specifically concerned with an electrode structure which, in combination with the quartz tube geometry and the mercury, metal halide, and noble gas fill, makes the high efficacy possible.

Metal halide discharge lamps typically have a quartz tube that forms a bulb or envelope and defines a sealed arc chamber, a pair of electrodes, e.g. an anode and a cathode, which penetrate into the arc chamber inside the envelope, and a suitable amount of mercury and one or more metal halide salts, such as NaI, or $ScI_3$, also reposed within the envelope. The vapor pressures of the metal halide salts and the mercury affect both the color temperature and efficacy. These are affected in turn by the quartz envelope geometry, anode and cathode insertion depth, arc gap size, and volume of the arc chamber in the envelope. Higher operating temperatures of course produce higher metal halide vapor pressures, but can also reduce the lamp life cycle by hastening quartz devitrification and causing tungsten metal loss from the electrodes. On the other hand, lower operating temperatures, especially near the bulb wall, can cause salt vapor to condense and crystallize on the walls of the envelope, causing objectionable flecks to appear in objects illuminated by the lamp.

Many metal halide discharge lamps of various styles and power ranges, and constructed for various applications, have been proposed, and are well known to those in the lamp arts. Lamps of this type are described, e.g. in U.S. Pat. Nos. 4,161,672; 4,808,876; 3,324,332; 2,272,467; 2,545,884; and 3,379,868. These are generally intended for high power applications, i.e., large area illumination devices or projection lamps. It has not been possible to provide a small lamp of high efficacy that could be used in a medical examination lamp or other application at a power of under about 40 watts. No one has previously approached lamp building with a view towards applying heat management principles to produce a lamp that would operates at low power and high efficacy and develops sufficient mercury and metal halide vapor pressures within the arc chamber without causing devitrification and softening of the quartz tube envelope, and without causing damage to the tungsten electrodes.

OBJECTS AND SUMMARY OF THE INVENTION

It is an object of the present invention to provide a low-power, high-efficacy metal-halide discharge lamp that avoids the drawbacks of such lamps of the prior art.

It is a more specific object to provide a metal-halide discharge lamp that has reasonably long life while delivering light at efficacies exceeding 35 lumens per watt.

It is a still more specific object to provide cathode and anode structure that permits effective heat management within the arc chamber and thus promotes high efficacy illumination at low power input.

In accordance with an aspect of the present invention, the lamp has a quartz or equivalent tube envelope of the double-ended type having a first neck on one end and a second neck on an opposite end of a bulb. There are suitable quantities of mercury and metal halide salt or salts contained within the bulb. The bulb wall defines a cavity or arc chamber to contain the metal halide salt vapors and mercury vapor during operation. First and second elongated electrodes formed of a refractory metal, i.e. tungsten wire, extends through the respective necks into the arc chamber.

These electrodes are aligned axially so that their tips define an arc gap between them of a suitable arc length.

In the lamps of the present invention, each of the electrodes is of a composite design, i.e., is in the form of a club, with a lead-in wire of small diameter, i.e. 0.003 to 0.007 inches, supported in the quartz of the associated neck in the lamp end, and a post member of greater diameter, i.e., 0.011 to 0.014 inches, supported on the lead-in wire. The lead-in wire enters the chamber sufficiently so that the post member is supported out of contact with the quartz of the neck and also out of contact with the bulb wall. The larger size of the electrode post member allows heat at the tip to diffuse back into the post member, so that the metal at the pointed tip will be cooled enough not to evaporate. The narrow lead-in wire keeps most of the heat in the bulb, so that the flow of heat out the neck is limited. This permits adequate salt vapor pressure to be sustained at the low wattage employed.

In order to minimize "arc dancing" i.e., to keep the discharge arc at the central axis of the arc chamber, the tips of the post members are favorable conic pointed, with a taper angle that is sharp enough to prevent arc dancing but shallow enough so that there is good heat diffusion from the pointed tip into the body of the post member. For a cathode, this angle can be 30 degrees to 45 degrees, and for an anode, 60 degrees to 120 degrees. In an AC lamp, the pointed tips of the electrodes can have identical taper angles.

Lamps of this design can operate at low power (5 to 14 watts) or intermediate power (14 to 30 watts) depending on the intended application, and in each case with a high efficacy. The efficacy can exceed 100 lumens per watt in some cases.

The narrow size of the lead-in wire portion of the electrode prevents thermomechanical stressing of the neck, which has a thermal coefficient of expansion quite different from tungsten.

Preferably, the chamber has flared regions where the necks join the bulb, so that there is an extended region, of very small volume, where each lead-in wire is out of direct contact with the quartz as it enters the chamber. This feature facilitates condensation of salt reservoirs at the neck behind one or the other of the electrode post members and also facilitates control of heat flow from the hot electrodes out into the necks of the lamp.

The foregoing and other objects, features, and advantages of the invention will be more fully appreciated from the ensuing detailed description of selected preferred embodiments, to be considered in conjunction with the accompanying Drawing.

DETAILED DESCRIPTION OF THE PREFERRED EMBODIMENT

Figure 1:
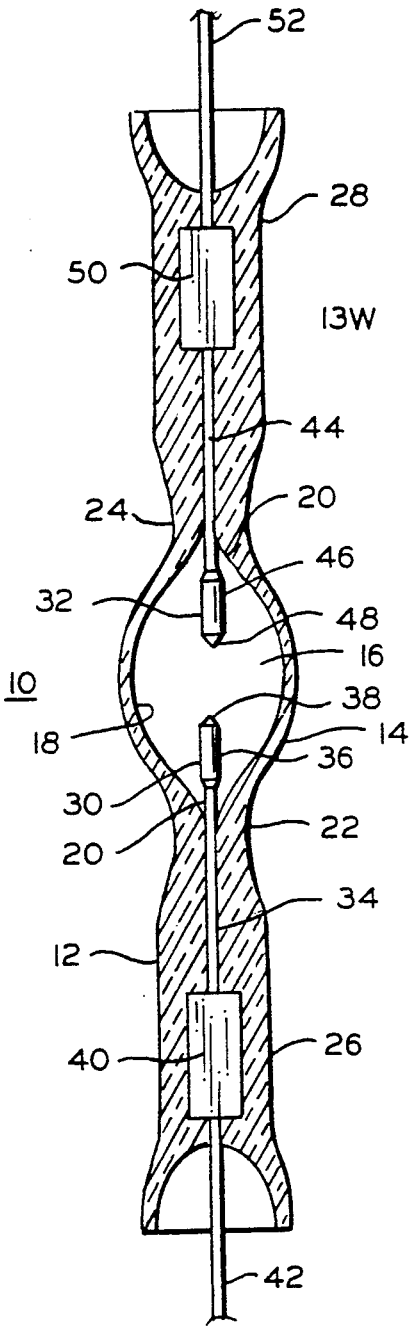
FIG. 1 is an elevational view of a quartz metal halide discharge lamp according to one embodiment of this invention.

With reference to the Drawing, and initially to FIG. 1, a twelve-watt lamp 10 comprises a double-ended fused quartz tube 12 which is formed by automated glass blowing techniques. The tube has a thin-wall bulb 14 at a central portion defining within it a cavity or chamber 16. In this case, the chamber is somewhat lemon shaped or gaussian shaped, having a central convex portion 18, and flared end portions 20 where the bulb 14 joins first and second necks 22, 24, respectively. As illustrated, the necks 22 and 24 are each narrowed in or constricted, which restricts heat flow out into respective first and second shanks 26 and 28.

There are first and second electrodes 30 and 32, each supported in a respective one of the necks 22, 24. The electrodes are formed of a refractory metal, e.g. tungsten, and are of a "composite" design, that is, more-or-less club-shaped.

The first electrode 30, which serves as anode, has a lead-in tungsten wire shank 34 that is supported in the neck 22 and extends somewhat into the chamber 16 where a tungsten post portion 36 is butt-welded onto it. The lead-in wire is of rather narrow gauge, typically 0.007 inches, and the post portion is of somewhat greater diameter, typically 0.014 inches. The post portion 36 has a conic tip 38 which forms a central point, with a flare angle in the range of 60 degrees to 120 degrees.

The tungsten lead in wire 34 extends through the quartz shank 26 to a molybdenum foil seal 40 which connects with a molybdenum lead in wire that provides an electrical connection to the positive terminal of an appropriate ballast (not shown).

The cathode electrode 32 similarly has a tungsten lead-in wire 44 that extends in the shank 28 and is supported in the neck 24. The wire 44 extends somewhat out into the chamber 16 and a post portion 46 is butt-welded onto it. The cathode post portion 46 has a pointed, conic tip 48 with a taper angle on the order of 30 degrees to 45 degrees. Here the wire 44 is typically of 0.007 inches diameter while the post portion can be of 0.011 inches diameter. The lead in wire 44 extends to a molybdenum foil seal 50 that connects to an inlead wire 52.

The post portions 36, 46 of the anode and cathode are supported out of contact with the necks 22, 24, and out of contact with the walls of the bulb 14.

The anode 30 and cathode 32 are aligned axially, and their tips 38, 48 define between them an arc gap in the central part of the chamber 16. The taper angles of the pointed tips 38, 48, are selected to be sharp enough to minimize arc dancing, i.e. movement of the arc within the arc chamber. At the same time, the taper angles should be shallow enough so that there is good thermal diffusion from the pointed tips 38, 48 into the main portions of the post members. The post portions have a rather large surface area that is in contact with the mercury and metal halide vapors in the lamp, so the heat conducted away from the pointed tips 38,48 is largely transferred to the vapors in the chamber.

As is apparent in the drawing figures, the anode post portion 36 is somewhat larger than the cathode post portion 46, and the pointed tip 38 has a somewhat larger taper angle than the tip 48. This is a consequence of the operating conditions of a DC lamp in which more heat is produced at the anode tip 38. However, in an AC lamp, the electrodes could be of like dimensions. The lead-in wires and post portions each have a circular cross section in this embodiment.

While not shown in this view, the lamp 10 also contains a suitable fill of a small amount of a noble gas such as argon, mercury, and one or more metal halide salts such as sodium iodide or scandium iodide. The particular metal salts selected, and their respective proportions, depend on their optical discharge characteristics in relation to the desired wavelength distribution for the lamp.

Figure 2:
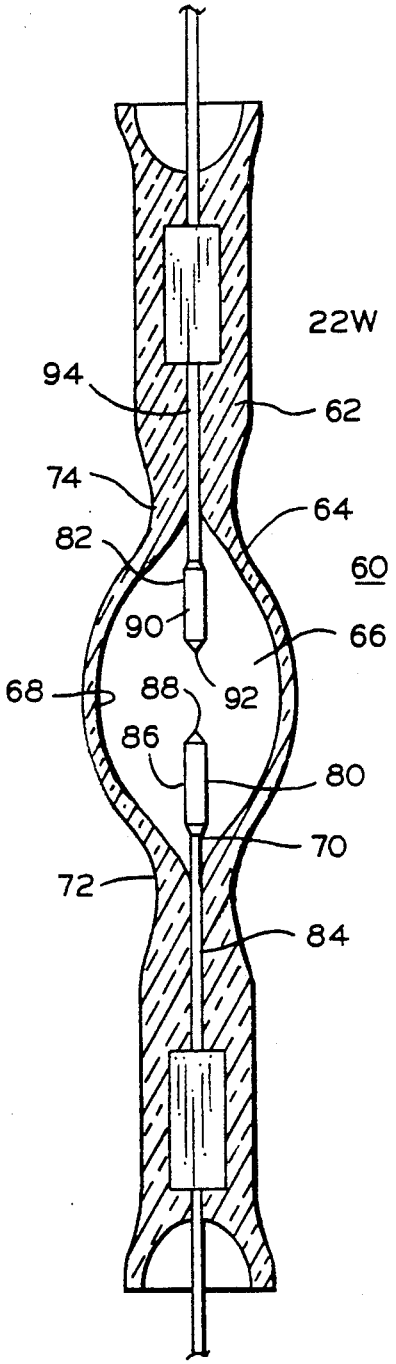
FIG. 2 is a quartz metal halide discharge lamp according to another embodiment of this invention.

FIG. 2 illustrates another lamp 60 according to an embodiment of this invention. This lamp 60 is of somewhat higher power, here about 22 watts. The lamp 60 has a quartz tube 62 of the double-ended type formed with a bulb 64 defining an arc chamber 66, which is of similar shape to that of the bulb of the first embodiment. The arc chamber 66 has a main convex portion 68 and flared end portions 70 where the bulb 64 joins a first neck 72 and a second neck 74. An anode 80 and a cathode 82 are respectively supported in the first and second necks 72, 74 in a fashion similar to that of the first embodiment. The anode has a tungsten lead-in wire 84 on which a post member 86 is butt-welded. The post member has a conic pointed tip 88. The anode 82 similarly has a post member 90 having a conic pointed tip 92, with the post member 90 being attached to one end of an associated lead-in wire 94 that is supported in the respective neck 74. As illustrated, the chamber 66 is somewhat larger than the chamber 16 of the first embodiment, and the arc gap defined between the anode 80 and cathode 82 is somewhat longer than the corresponding arc gap in the first embodiment. As is also apparent from the drawing figures, the post portions 86 and 90 in this embodiment are somewhat larger than the corresponding post portions 36 and 46. The size of the post portions depends on the lamp power, as the amount of heat that develops near the electrode tips will be greater in the higher wattage lamps. However, the diameter of the lead-in wire can be the same over a large range of lamp sizes. The factor that limits narrowness of the lead-in wire is resistive heating. However, for the power ranges employed, resistive heating of the lead-in wires does not play a significant role. The lead-in wires for the electrodes, being made of tungsten, have about 90 to 96 times higher coefficient of heat conductivity than does the quartz material of the tube 12. Therefore, it is desirable to keep the lead-in wires 34, 44, as small in diameter as is possible.

It should be recognized that the smaller-diameter lead-in wire portions of the electrodes will experience only a relatively small amount of thermal expansion due to heating of the tungsten wire. This occurs for two reasons: The smaller-diameter wire does not carry nearly as much heat up the respective necks as if electrodes the size of the post portions continued up to the necks. Secondly, because the amount of thermal expansion is proportional to the over-all size, and where this size is kept small, stresses due to thermal expansion are also kept small. Because of this, the construction of this invention presents a reduced risk of cracking of the fused quartz due to the differential thermal expansion of the quartz and tungsten materials.

Figure 3:
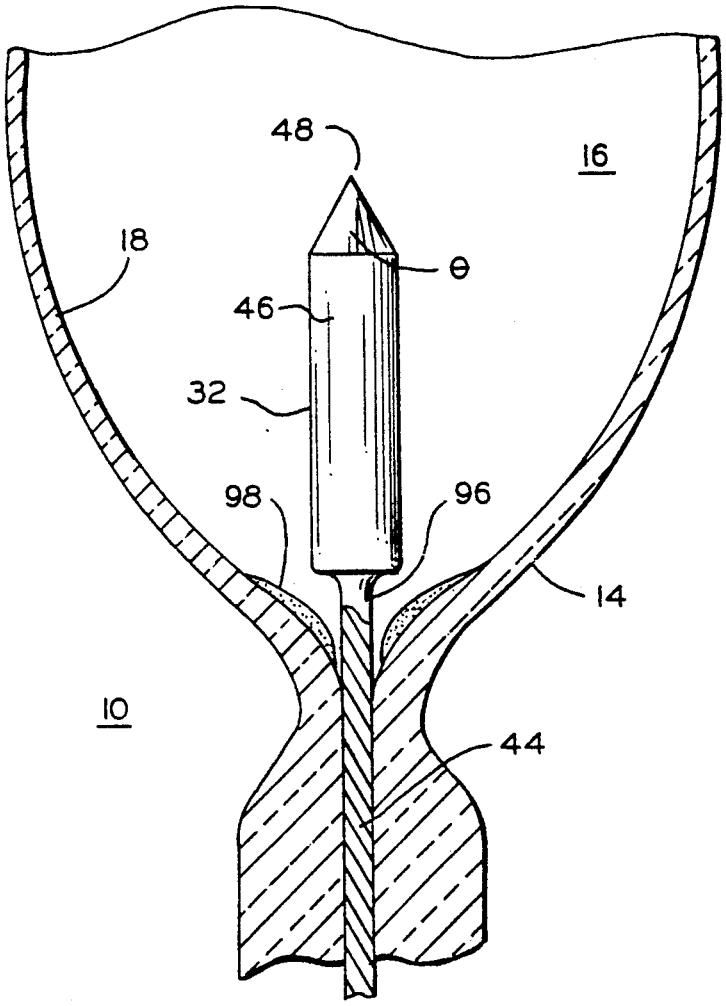
FIG. 3 is an enlarged section of a portion of the lamp of FIG. 1.

FIG. 3 shows a portion of the lamp structure of FIG. 1. Here, the shape of the bulb 14 and one of its flared end portions 20 is illustrated in conjunction with the cathode 32. A butt weld 96 joins the cathode post portion 36 onto the associated lead-in wire 44. The lead-in wire 44 is out of contact with the quartz material of the bulb 14, and is also out of contact with the associated neck 24 from the butt weld 96 back a substantial distance into the neck 24. This, in combination with the geometry of the neck 24 which limits the flow of heat along the wall of the bulb 14 from the hotter portions of the bulb, limits the heat flow at and near the neck. In this design, a salt pool 98 or salt reservoir tends to form adjacent the neck 24 at a position behind the post portion 46 of the cathode within the convex portion 18 of the arc chamber. This zone of the lamp is somewhat cooler than elsewhere within the chamber 16 so that the excess salt condenses here rather than on the wall of the bulb. This salt reservoir provides additional metal halide salt to compensate for salt which may be lost during operation over the life cycle of the lamp 10.

While this invention has been described in detail with reference to selected preferred embodiments, it should be understood that the invention is not limited to those precise embodiments. Rather, many modifications and variations would present themselves to those of skill in the art without departing from the scope and spirit of this invention, as defined in the appended claims.

What is claimed is:

1. A metal halide discharge lamp in a power range of about 5 watts to 40 watts and having an efficacy exceeding 35 lumens per watt that comprises a quartz tube envelope of the double-ended type having a first neck and a second neck axially arranged on opposite ends of a bulb having a bulb wall that defines an arc chamber of a predetermined volume, predetermined quantities of mercury and a metal halide salt within said chamber, and first and second elongated electrodes of a refractory metal each extending axially through a respective one of the necks into said arc chamber, each of said first and second electrodes having axial tips spaced apart to define an arc gap therebetween; wherein the improvement comprises each of said first and second electrodes having a lead-in wire of diameter 0.007 inches or less formed of said refractory metal supported in the quartz of the associated neck and entering the chamber and a post member composed of said refractory metal and supported on said lead-in wire out of contact with said neck and said bulb wall, each said post member being of a diameter up to about 0.014 inches and larger than its associated lead-in wire, the larger diameter post portions having a relatively large surface area in contact with the mercury and metal halide vapors in the lamp so that heat conducted away from the tips of said electrodes is predominately transferred to the vapors in the chamber, while the smaller diameter lead in wires conduct only a small amount of the heat into the respective neck portions, thereby limiting heat flow from the chamber at or near the neck portions.

2. The metal halide discharge lamp of claim 1 wherein each said post member has a conic pointed tip.

3. The metal halide discharge lamp of claim 2 wherein the conic tip of one of said post members has a taper angle of between about 30 degrees and 45 degrees, and the conic tip of the other post member has a taper angle of between about 60 degrees and 120 degrees.

4. The metal halide discharge lamp of claim 1 wherein each of said lead-in wires has a circular cross section and each said post member also has a circular cross section.

5. The metal halide discharge lamp of claim 4 wherein for one of said electrodes the lead-in wire has a diameter of 0.007" and the post member has a diameter of 0.011".

6. The metal halide discharge lamp of claim 4 wherein for one of said electrodes the lead-in wire has a diameter of about 0.007" and the post member has a diameter of 0.014".

7. The metal halide discharge lamp of claim 1, having sufficient arc gap and quantities of mercury and halide, and electrode post members of sufficient length and diameter to operate in the range between about 5 and 14 watts.

8. The metal halide discharge lamp of claim 1, having sufficient arc gap and quantities of mercury and halide, and electrode post members of sufficient length and diameter to operate in the range between about 14 and 30 watts.

9. The metal halide discharge lamp of claim 1, wherein each of said post members is butt-welded onto an end of the associated lead-in wire.

10. The metal halide discharge lamp of claim 1 wherein said chamber has flared portions where the electrode lead-in wires emerge from the respective necks.

11. The metal halide discharge lamp of claim 1 wherein said post members have a diameter of about 0.011 to 0.014 inches.

* * * * *